US008074309B2

(12) United States Patent
Hutchison et al.

(10) Patent No.: US 8,074,309 B2
(45) Date of Patent: Dec. 13, 2011

(54) HEIGHT ADJUSTABLE BED WITH A LIFT CHAIN ASSEMBLY AND COMPONENTS THEREOF

(75) Inventors: Stephen E Hutchison, Batesville, IN (US); David W Hornbach, Brookville, IN (US); Darrell L Metz, Batesville, IN (US)

(73) Assignee: Hill-Rom Services, Inc.

( * ) Notice: Subject to any disclaimer, the term of this patent is extended or adjusted under 35 U.S.C. 154(b) by 420 days.

(21) Appl. No.: 12/397,511

(22) Filed: Mar. 4, 2009

(65) Prior Publication Data

US 2010/0223728 A1 Sep. 9, 2010

(51) Int. Cl.
*A61G 7/005* (2006.01)
*A61G 7/012* (2006.01)

(52) U.S. Cl. ..... 5/610; 5/611

(58) Field of Classification Search ..... 5/610, 611; 108/4, 147; 254/6 R, 6 C, 95, 97; 74/415, 74/89.18

See application file for complete search history.

(56) References Cited

U.S. PATENT DOCUMENTS

| | | | | |
|---|---|---|---|---|
| 980,181 A | | 1/1911 | Asbury | |
| 2,770,371 A | * | 11/1956 | Soden | 211/104 |
| 2,818,189 A | | 12/1957 | Schreck | |
| 3,021,024 A | | 2/1962 | Nagin | |
| 3,082,893 A | | 3/1963 | Hollings | |
| 3,153,940 A | | 10/1964 | Patrignani | |
| 3,672,237 A | | 6/1972 | Nagin | |
| 3,820,176 A | * | 6/1974 | Feiertag | 5/611 |
| 3,831,455 A | * | 8/1974 | Patrignani | 74/89.21 |
| 4,014,136 A | | 3/1977 | Hemens et al. | |
| 4,037,744 A | | 7/1977 | Nagin, Jr. et al. | |

(Continued)

FOREIGN PATENT DOCUMENTS

EP 0982018 B1 6/2006

OTHER PUBLICATIONS http://www.motioncontrol.com/products/index.cfm/Serapid-Lift-Chain-Catalog, New Lift Chain Catalog Available from Serapid, Jul. 1, 2008, Filed Under: Linear Motion Mechanical Components, Serapid 5400 18 Mile Road Sterling Heights, MI 48314 US Phone: 586-274-0774 Website: www.serapid.com.

(Continued)

*Primary Examiner* — Michael Trettel
(74) *Attorney, Agent, or Firm* — Kenneth C. Baran

(57) ABSTRACT

A bed 14 has a base frame 32, an elevatable frame 34 and a telescopable column 36 having a base segment **36*a* connected to the base frame 32 and a terminal segment 36*e* connected to the elevate able frame 34. Each column circumscribes a lift chain assembly 100 which includes a magazine 102 and a lift chain 160 with a terminal link 240. The magazine 102 is connected to either the base frame 32 or the elevate able frame 34 and the terminal link 240 is connected to the other of the base frame 32 and the elevate able frame 34. The magazine 102 comprises left and right magazine covers 104, 106 each having an outer face and an inner face 112, 114 with grooves 120. The lift chain 160 has left and right rollers 238 that project into the grooves. The lift chain assembly 100 also includes a gear train 320 extending from a gear train drive shaft 334 to a gear train output shaft 338 and a motor 278 having an output shaft 314 connected to the gear train drive shaft 334**.

8 Claims, 18 Drawing Sheets

U.S. PATENT DOCUMENTS

| | | | | |
|---|---|---|---|---|
| 4,299,585 | A | 11/1981 | Nagin, Jr. et al. | |
| 4,406,096 | A | 9/1983 | Matsutani | |
| 4,644,595 | A | 2/1987 | Daniel | |
| 4,830,337 | A * | 5/1989 | Ichiro et al. | 254/95 |
| 5,156,574 | A | 10/1992 | Gai | |
| 5,273,392 | A | 12/1993 | Bernard, II et al. | |
| 5,402,543 | A * | 4/1995 | Dietrich et al. | 5/610 |
| 5,425,442 | A | 6/1995 | Lichti | |
| 5,896,702 | A | 4/1999 | Waehrens et al. | |
| 6,109,424 | A | 8/2000 | Doan | |
| 6,224,037 | B1 * | 5/2001 | Novick | 254/95 |
| 6,505,365 | B1 * | 1/2003 | Hanson et al. | 5/613 |
| 6,684,419 | B1 | 2/2004 | Perla | |
| 7,647,659 | B2 * | 1/2010 | Frolik et al. | 5/509.1 |
| 2002/0111236 | A1 | 8/2002 | Prince | |
| 2004/0177934 | A1 | 9/2004 | Olmsted | |
| 2006/0219144 | A1 | 10/2006 | Phelan et al. | |
| 2007/0107125 | A1 | 5/2007 | Koch et al. | |

OTHER PUBLICATIONS http://www.concisemotion.com/chain.htm, Innovative Compact Motion Solutions, PushPull Chain/LinearChain, Date Unknown, Concise Motion Systems 9440-L San Mateo NE Albuquerque, NM 87113 USA.

http://motionsystemdesign.com/mag/choosing_rigid_chain/, Motion System Design, Choosing rigid chain for power, By Greg Dettloff Serapid USA Inc. Sterling Heights, MI, Oct. 1, 2008.

http://motionsystemdesign.com/mag/PTRAN-PIC2b-serapid_full.jpg, Date Unknown.

http://www.serapid.com/gb/new_products/chainlift.html, Chain Lift, Date Unknown.

http://www.serapid.com/gb/new_products/hdlift.html, Heavy Duty Lift Systems, Date Unknown.

http://www.serapid.com/gb/new_products/housing_chains.html, Serapid Mechanical Actuators: Housing and Chains, Date Unknown.

http://www.serapid.com/gb/theatre/th_app_av_gb.html, Serapid Lift Products Applications and Advantages, Date Unknown.

Linear Chain, D5-239e2/09.05, Drive housing 25, 40, 60, Frame Morat GmbH & Co. KG, Hochst 7 D-79871 Eisenbach Telephone: +49 (0) 7657 / 88-0.

Linear Chain, D5-247e2/09.05, Magazine Covers, Frame Morat GmbH & Co. KG, Hochst 7 D-79871 Eisenbach Telephone: +49 (0) 7657 / 88-0.

http://www.framo-morat.com/e/LinearChain/LinearChain.html, Framo Morat—LinearChain, Jan. 25, 2008.

* cited by examiner

HEIGHT ADJUSTABLE BED WITH A LIFT CHAIN ASSEMBLY AND COMPONENTS THEREOF

TECHNICAL FIELD

The subject matter described herein relates to height adjustable beds and particularly to a bed whose height adjustment system employs a lift chain assembly.

BACKGROUND

Patient beds used in health care facilities and home care settings often include a lift system allowing a patient or caregiver to adjust the height of the bed. The lift system must satisfy a number of potentially conflicting constraints. For example, the lift system should be quiet, dependable, safe and damage resistant. It should also be inexpensive to manufacture and should be adaptable to different bed models with no more than simple, inexpensive modifications. Because the lift system typically resides underneath the elevateable components of the bed, it must be compact enough to allow the bed to be positioned at very low elevations and yet must also have enough reach to position the bed at elevations high enough to be satisfactory for the caregiver. Compactness also makes space available for other under-bed components.

SUMMARY

A bed as disclosed herein has a base frame, an elevateable frame and at least one telescopable column. Each column circumscribes a lift chain assembly which includes a magazine and a lift chain with a terminal link. The magazine is connected to either the base frame or the elevateable frame and the terminal link is connected to the other of the base frame and the elevateable frame. The magazine comprises left and right magazine covers each having an outer face and an inner face with grooves. The lift chain has left and right rollers that project into the grooves. The lift assembly also includes a gear train extending from a gear train drive shaft to a gear train output shaft and a motor having an output shaft connected to the gear train drive shaft. The lift chain is made of left, right and medial link arrays comprised of left, right and medial links that are substantially identical to each other. Longitudinally opposite ends of the links are configured so that the chain resists bending about a lateral axis in one of two opposite rotational directions. A terminal link is connected to one extremity of the chain so that the center of action of the link is transversely offset from the chain meanline in a direction that would urge the chain to bend in the bend resistant direction. A link for the lift chain is a flat plate having a simple end and a compound end. The simple end includes a first convex circular arc and a ledge that form a first angle of less than 180 degrees. The compound end includes a second convex circular arc, a concave circular arc and a tooth with a crown. The concave arc and the crown form a second angle of no more than about 90 degrees.

The foregoing and other features of the various embodiments of the lift system described herein will become more apparent from the following detailed description and the accompanying drawings.

DETAILED DESCRIPTION

Figure 1:
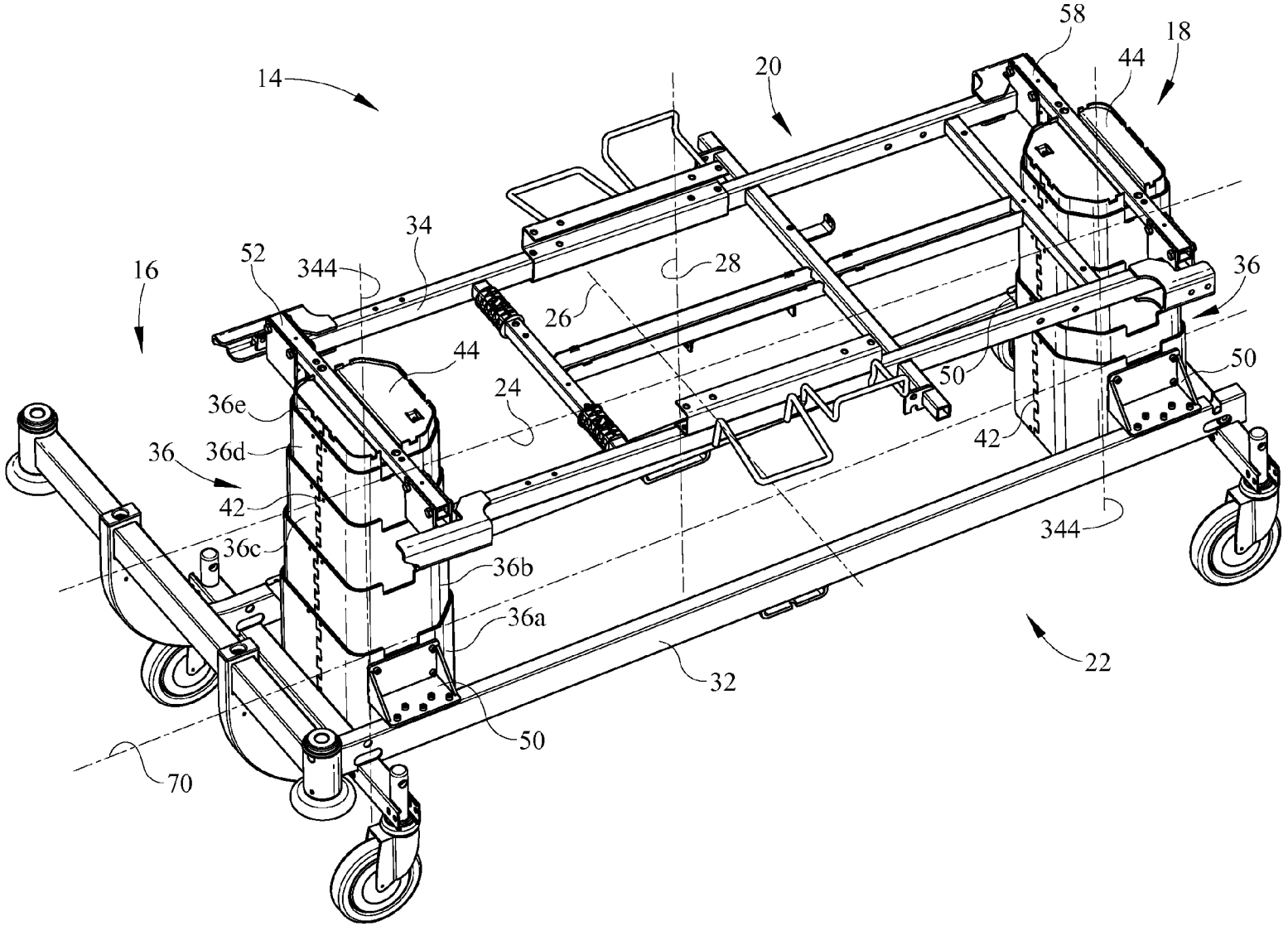
FIG. 1 is a perspective view of the framework of a height adjustable bed having two canister assemblies defining telescoping columns, each of which circumscribes a lift chain assembly, not visible, for changing the height of an elevateable portion of the framework.

FIGS. 1-4 show components of a hospital bed 14 with a lift system as described herein. The bed has a head end 16, a foot end, 18 a left side 20 and a right side 22. The illustration also depicts longitudinal, lateral and vertical directional axes 24, 26, 28. The bed includes a base frame 32, an elevateable frame 34 and a pair of canister assemblies 36 each comprising two or more canister segments. The illustrated embodiment has a bottom-most or base canister segment 36*a*, three intermediate segments 36*b*, 36*c*, 36*d* and an upper-most or terminal segment 36*e* fitted together to define head end and foot end telescopable columns 36. Each canister segment comprises two semi-segments joined together along two dovetail seams 42. The upper-most or terminal segment 36*e* of each column includes an upper cover plate 44 at its vertically upper end. The bottom-most or base segment 36*a* of each column includes laterally extending mounting bars 46 joined to the base segment. The bars extend through and are secured to a mounting block 48 near one lateral side of the segment. The mounting block 48 serves as a mounting location for a chain as described more completely hereinafter. Alternatively, the mounting location could be a plate similar to cover plate 44. Each base segment 36*a* is securely connected to the base frame by brackets 50 or in any other suitable way to anchor the base segment to the base frame.

Figure 5:
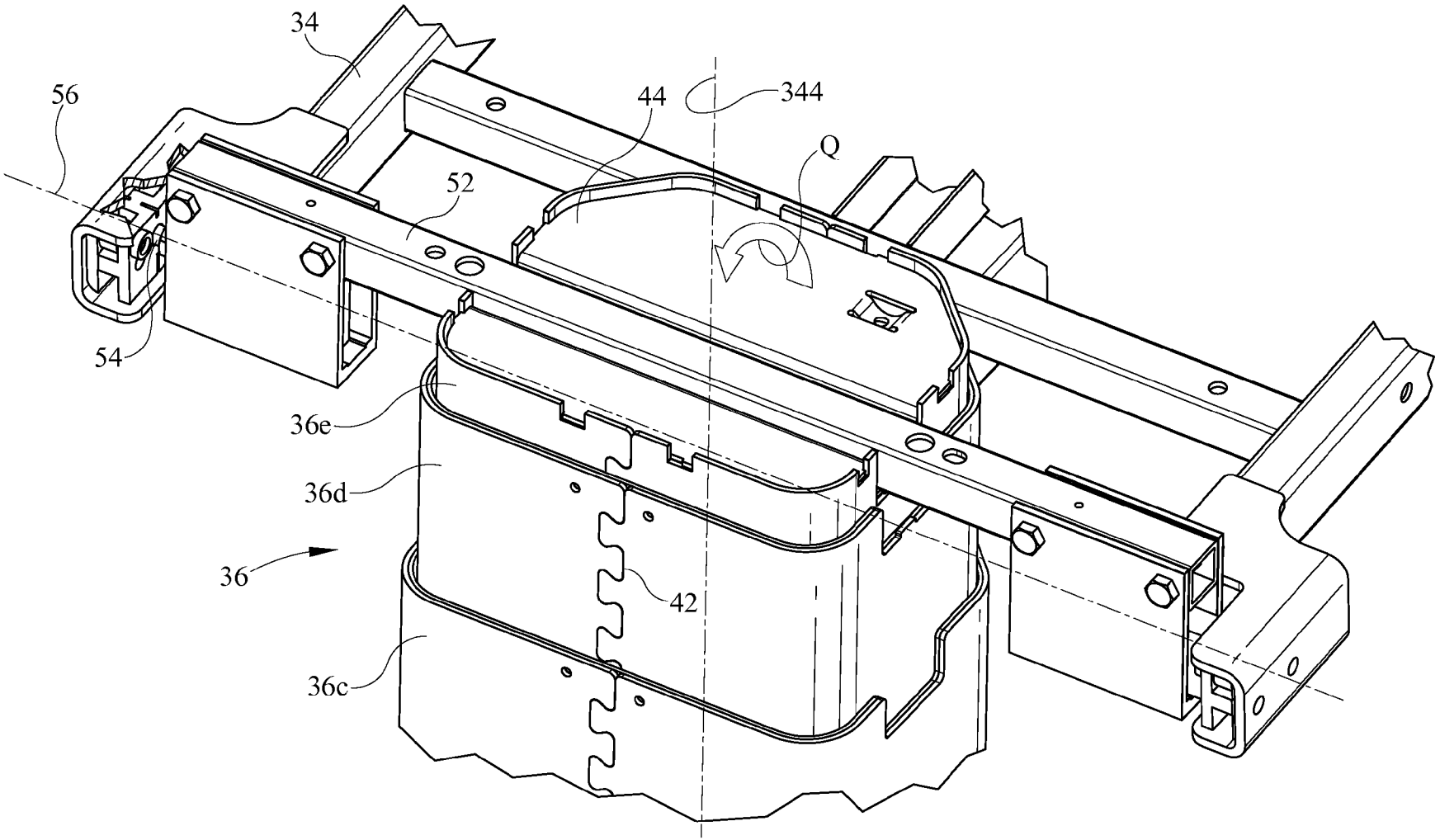
FIG. 5 is a perspective views of the upper portions of the head end canister assembly showing hinge pins allowing the head end of the elevateable frame to pivot relative to the canister.
Figure 6:
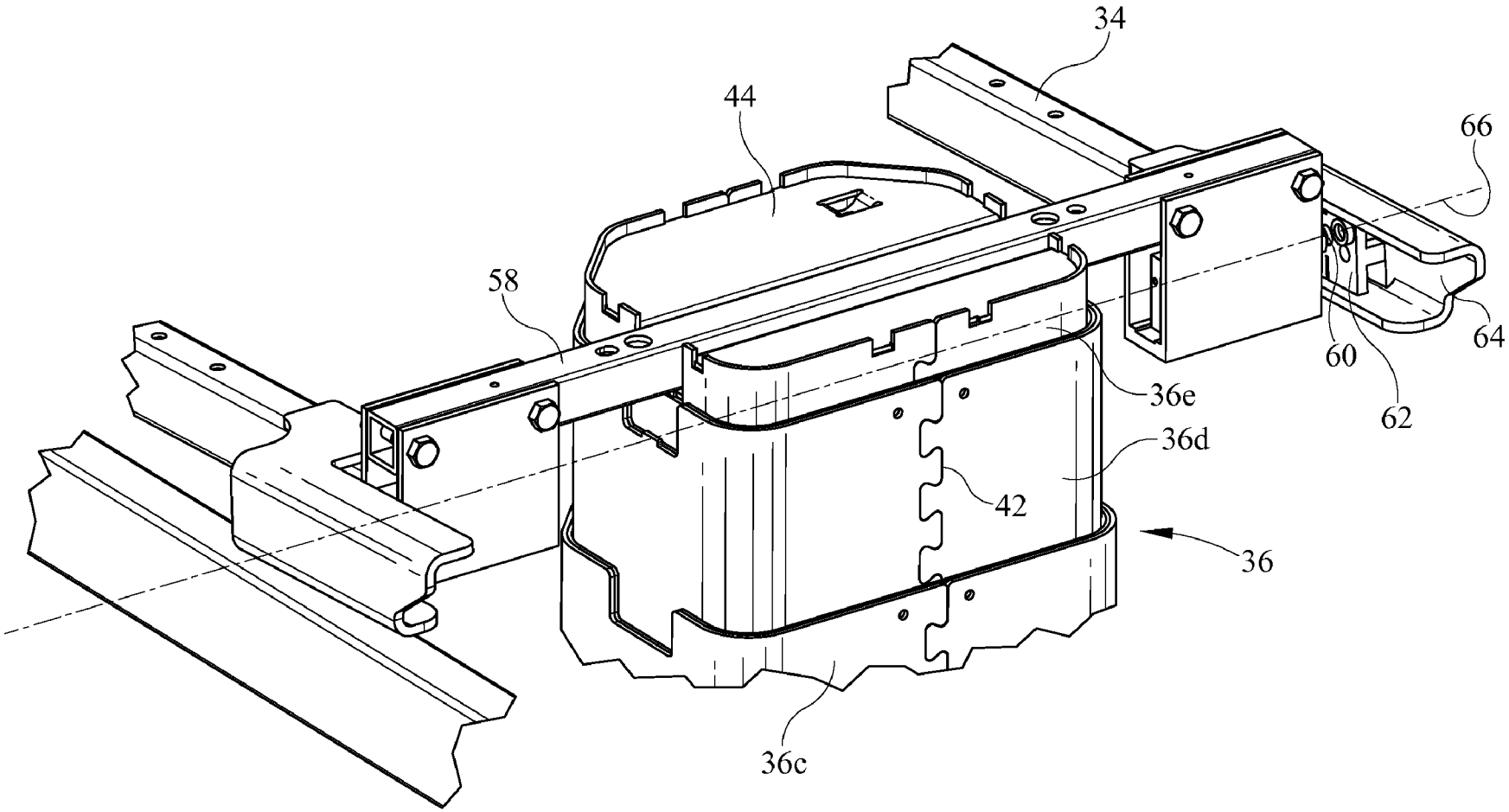
FIG. 6 is a perspective view of the upper portions of the foot end canister assembly showing hinge pins allowing the foot end of the elevateable frame to pivot relative to the canister and also showing slider blocks trapped in a track for allowing translation of the elevateable frame relative to the canister assembly.
Figure 7:
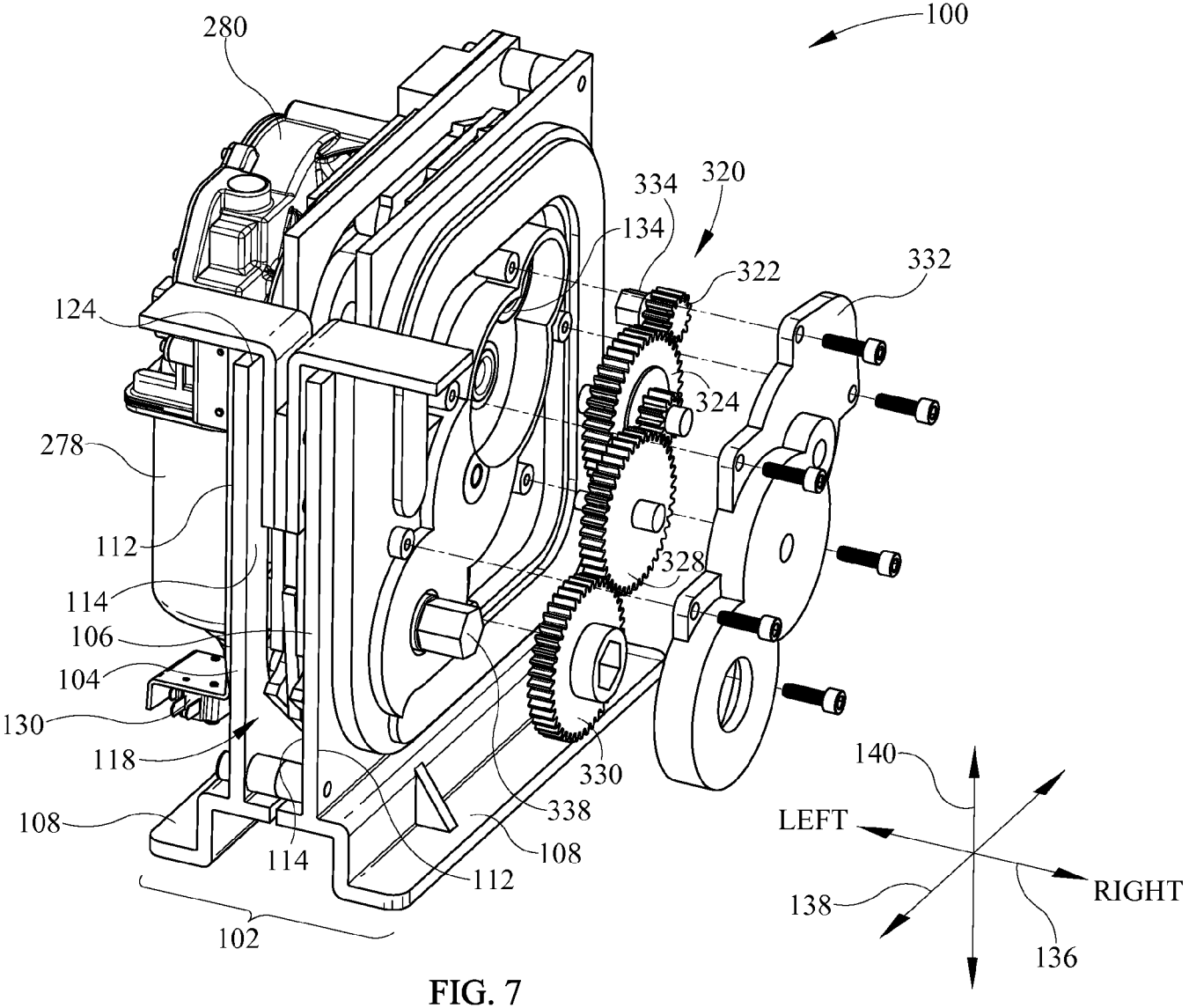
FIG. 7 is a perspective view of a lift chain assembly partially exploded to show components of a gear train.

Referring additionally to FIGS. 5 and 6, a head end crossbar 52 is secured to the terminal segment 36*e* of the head end column. Left and right hinge pins 54, only one of which is visible in FIG. 5, connect the head end of the elevateable frame 34 to the crossbar to provide for pivotal motion therebetween about axis 56. A foot end crossbar 58 is secured to the terminal segment 36*e* of the foot end column. Left and right hinge pins 60, only one of which is visible in FIG. 6, connect the crossbar 58 to respective left and right slider blocks 62. The slider blocks are trapped in a track 64 at the foot end of the elevateable frame 34, but can slide longitudinally in the track. The hinge thus formed provides for pivotal motion of the elevateable frame relative to the crossbar about a longitudinally translatable pivot axis 66. The rotational freedom at the head end, in combination with the rotational and translational freedom at the foot end, allows the columns to be telescoped to different heights to place the upper frame at a positive or negative pitch orientation $\alpha$ (FIG. 3) relative to horizontal. Other mechanical arrangements could also be used to achieve the angular orientation $\alpha$.

Figure 2:
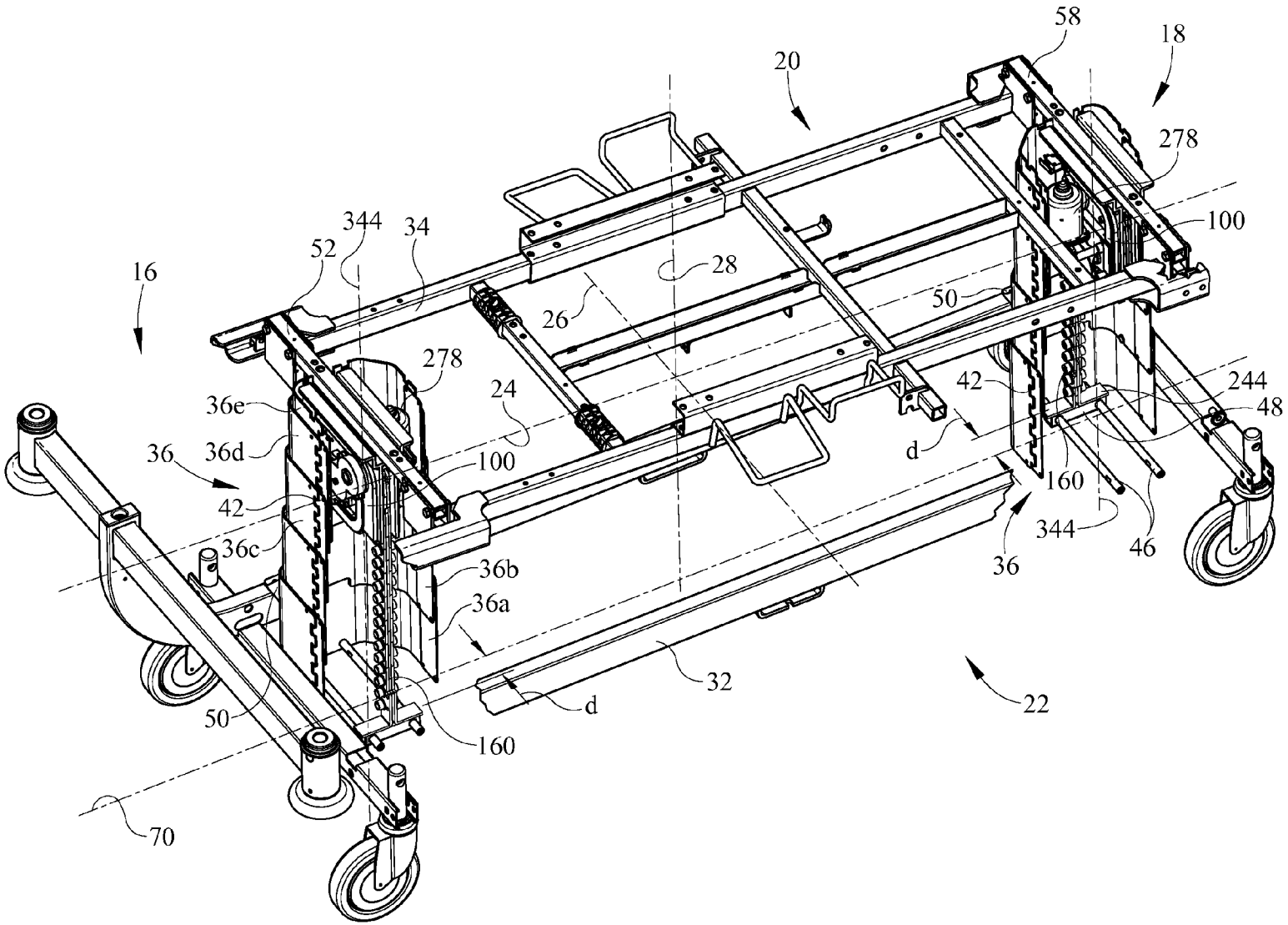
FIG. 2 is a view similar to FIG. 1 with the telescoping columns broken away to reveal the lift chain assemblies.

In the above described embodiment the bottom-most segment 36*a* of each column is non-rotationally secured to the base frame by the brackets 50. In another embodiment, the segment 36*a* is secured to the base frame in a way that allows the segment 36*a*, and therefore the entire column and the elevateable frame, to pivot about a longitudinally extending pivot axis 70 (FIGS. 1 and 2). U.S. patent application Ser. No. 12/194,937 filed on Aug. 20, 2008 and entitled "Laterally Rotating Patient Support Apparatus", the contents of which are incorporated herein by reference, describes the details of the pivot system. The use of the described pivot system in conjunction with the lift system described herein results in a particularly compact package, however the lift system described herein can also be employed advantageously without the described pivot system.

Figure 18:
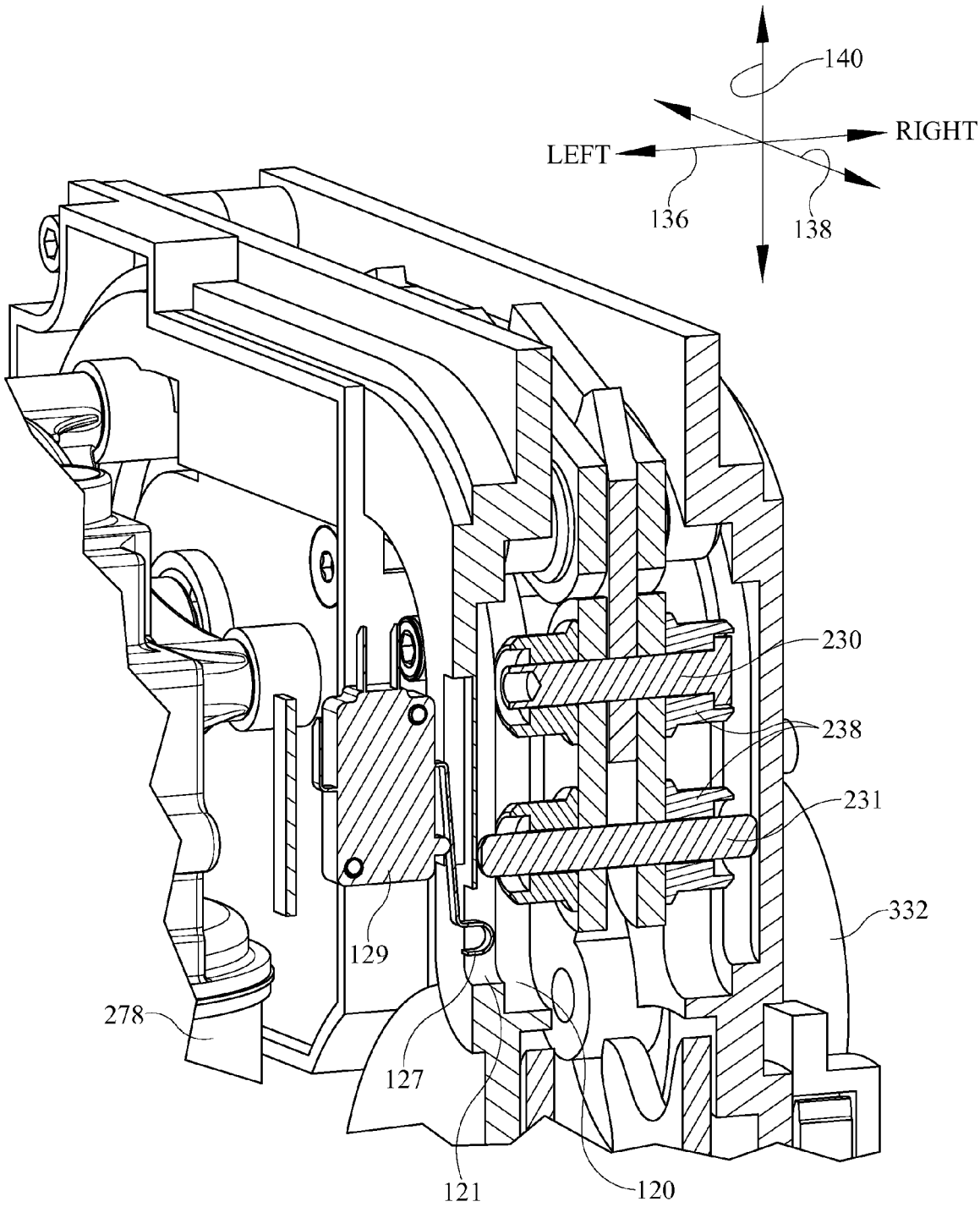
FIG. 18 is a perspective view of a portion of the lift chain assembly showing a switch and a switch contact element for limiting extension and retraction of the chain.

Referring principally to FIGS. 2, 3 and 7-9, each telescopable column 36 circumscribes a lift chain assembly 100. Each lift chain assembly includes a magazine 102 comprised of magazine covers 104, 106. Each cover has a mounting flange 108, an outer face 112 and an inner face 114. The covers are secured together by five bolts 116 but spaced from each other to define an inter-cover space 118. The inner faces 114 each include a coil shaped groove 120 having a terminal leg 122 seen best in FIGS. 8 and 9. The groove has a laterally deeper trench portion 121 (FIG. 18). The covers, including one end of each groove, cooperate with each other to define a window 124. Each cover includes a low friction bushing 126. A coupler 128 nests in the bushings and is rotatable relative thereto. As seen best in FIG. 9, the coupler has an input side 132 and an output side 134.

When referring to the lift chain assembly 100 it is useful to define local, lateral, longitudinal and transverse directional axes 136, 138, 140 specific to the lift chain assembly as indicated by the local coordinate axis system on FIGS. 3 and 7-9. Thus, the covers 104, 106 are referred to as laterally left and right covers even though in the illustrated embodiment they are oriented at 90 degrees to the left and right (lateral) direction 26 depicted on FIG. 1 for describing the bed as a whole. The local longitudinal direction 138 is the direction parallel to the planes defined by the inner faces 114 of the magazine covers. The local vertical or transverse direction 140 is a direction mutually perpendicular to the local lateral and longitudinal directions and is the same as the vertical direction of FIG. 1. It should be appreciated that the name of the directional axes are chosen for convenience in referring to the Figures and in no way constrain the actual orientation of the lift chain assembly relative to the other components of the bed.

Figure 14:
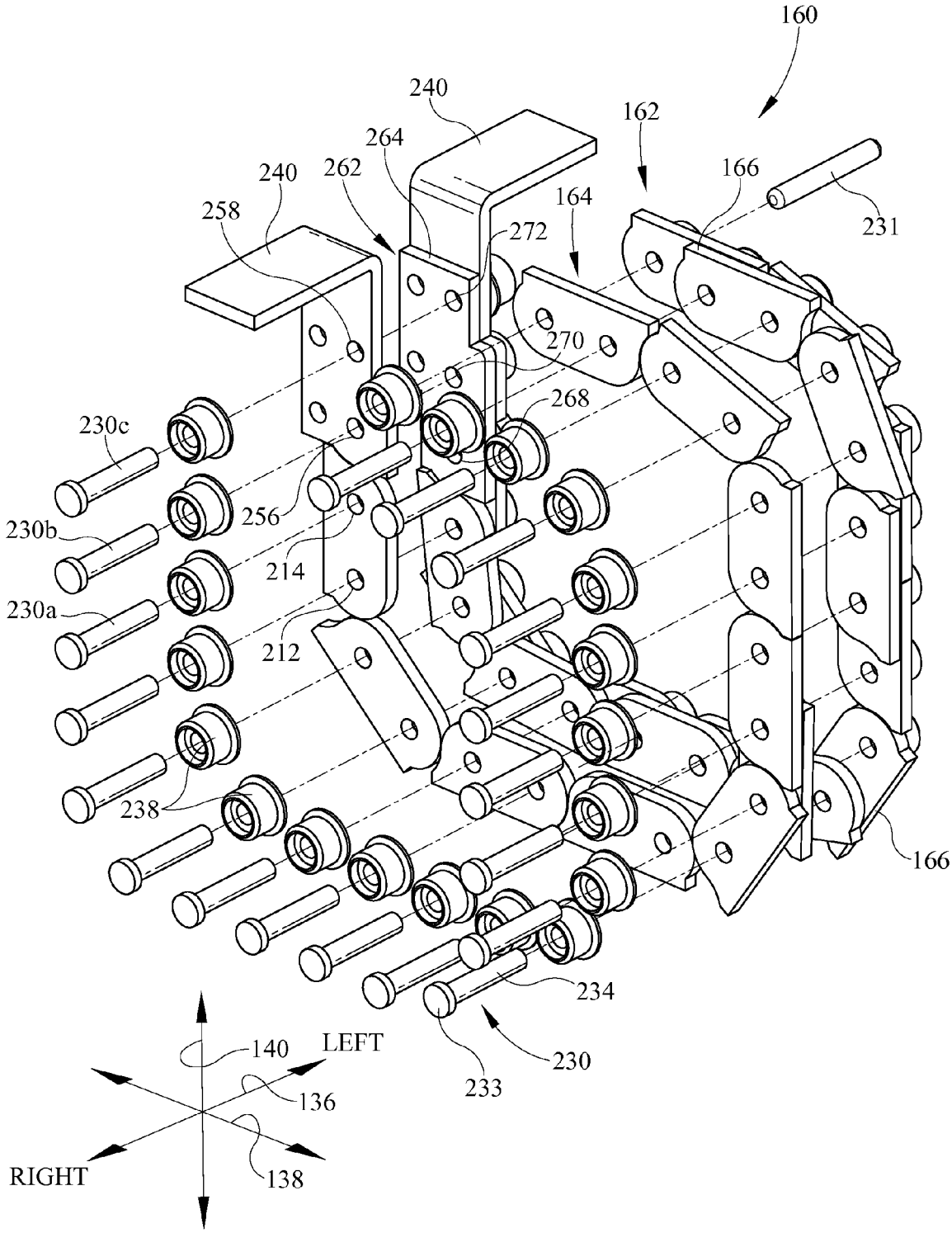
Figure 15:
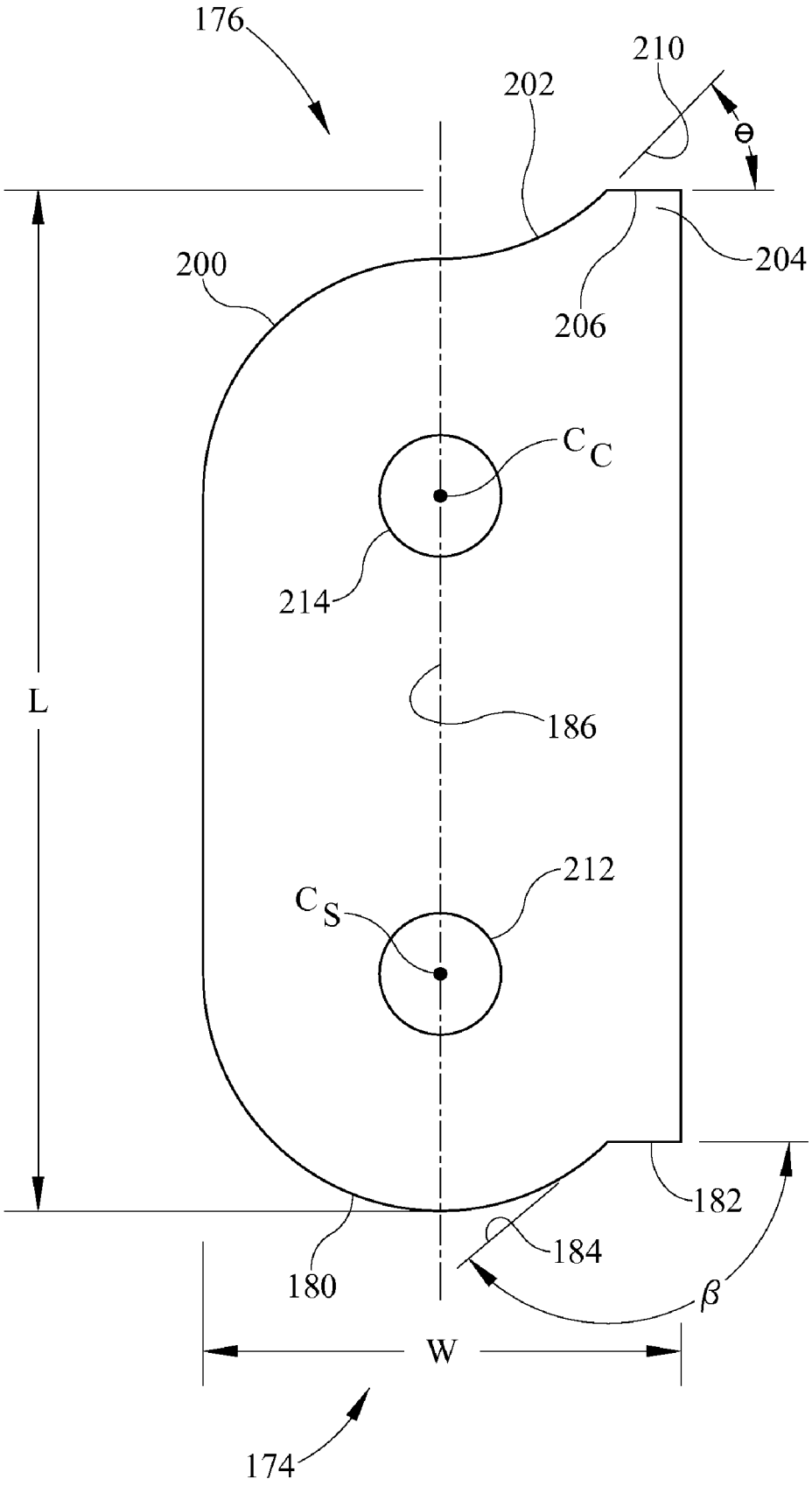
FIGS. 15 and 16 are a side elevation view and a perspective view of a representative link of the chain.
Figure 16:
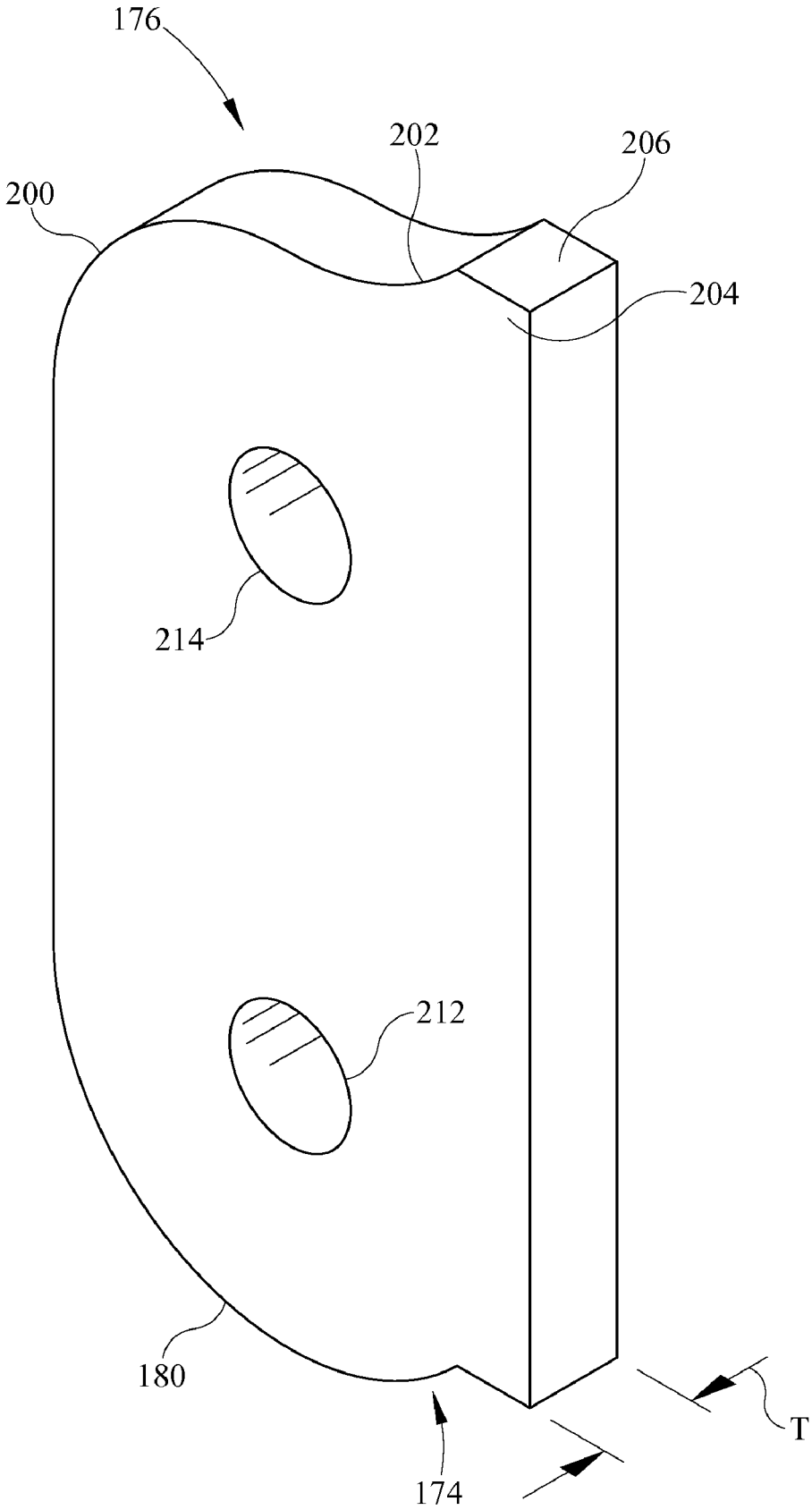

Referring additionally to FIGS. 10-16 the lift chain assembly also includes a chain 160 retractable into and extendible out of the magazine. The chain is made of left, right and medial chain link arrays 162, 164, 166 each comprised of respective left, right and medial links 168, 170, 172. Except for terminal links described below, all the links are substantially identical and are in the form of small flat plates as seen in FIGS. 15-16 having a length L, a width W and a thickness T. Each link has a simple end 174 and a compound end 176. The simple end of a representative link includes a convex circular arc 180 and a ledge 182. The ledge and a line 184 tangent to the arc at the juncture of the ledge and the arc form an angle $\beta$ of less than 180 degrees. The arc 180 has a center $C_S$ on the lengthwise meanline 186 of the link The compound end 176 of a representative link includes a convex circular arc 200, a concave circular arc 202 and a tooth 204 with a crown 206. One end of concave arc 202 blends with an end of convex arc 200. A line 210 tangent to the concave arc 202 at the juncture of the arc and the crown 206 forms an angle $\theta$ of no more than about 90 degrees with the crown. The arc 200 has a center $C_C$ on the lengthwise meanline 186 of the link. Holes 212, 214 centered on arc centers $C_S$, $C_C$ penetrate through each link.

Figure 11:
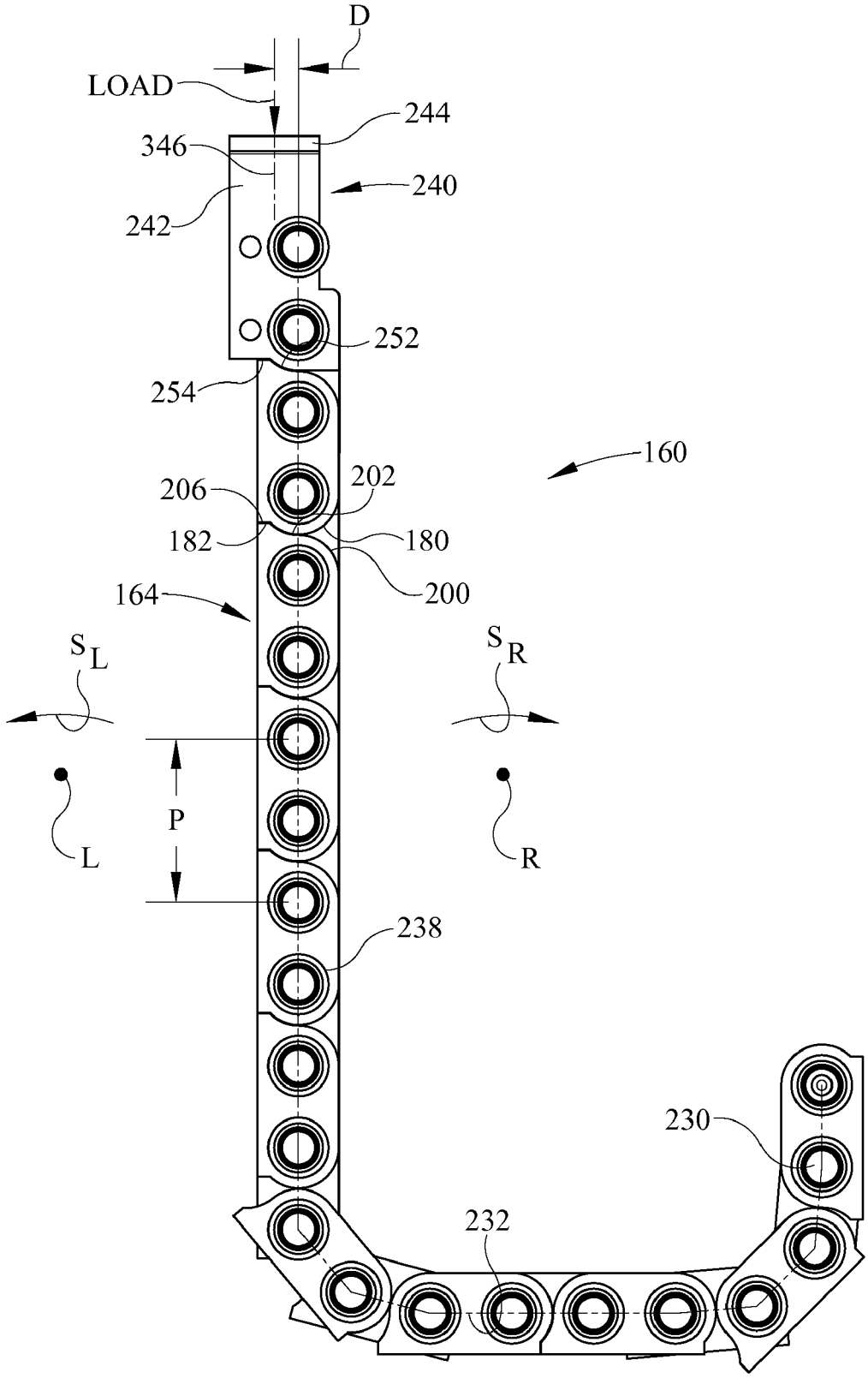

The chain also includes link connector pins 230 having a head 233 and a shank 234 (FIG. 14). The end of the shank remote from the head is deformable. Each pin 230 extends laterally through the holes 212, 214 and through a pair of rollers 238 to pivotably connect the links together so that the medial link array 166 laterally abuts the left and right link arrays 162, 164 and so that the links of the medial array are lengthwisely offset from the links of the left and right arrays by one-half pitch, where pitch is the lengthwise distance P (FIGS. 11 and 13) from a feature on the chain to the next adjacent occurrence of the same feature (e.g. between successive occurrences of holes 212). When so connected, the lengthwise meanlines 186 of the individual links define a chain meanline 232 FIG. 11. The configuration of the link ends allows the chain to flex about a laterally extending axis in only one of two opposite directions and to resist flexing in the other of the two directions. As illustrated in FIG. 11, contact between the ledge 182 of one link and the tooth crown 206 of the neighboring link, along with the interaction of the circular arcs 180, 202, prohibits the chain from flexing in rotational sense $S_L$ (e.g. about an axis L). However, circular arc 180 is able to roll relative to circular arc 200 thereby allowing the chain to flex in rotational sense $S_R$ (e.g. about an axis R).

As noted above, each pin carries a pair of rollers 238. The head of the pin traps one roller of the pair, e.g. the right roller, against a right link. The other end of the pin is deformed so that it traps the other roller against the opposite (e.g. left) link. The rollers 238 project laterally into the grooves 120 in the magazine covers 104, 106 to support the chain and cause it to coil inside the magazine when the chain is retracted.

The chain also includes left and right outboard terminal links 240 each having a leg portion 242 and a foot portion 244 which serves as a mounting flange. As seen best in FIG. 11 each outboard terminal link has a simple profile comprising a circular arc 252 and a ledge 254 not unlike the circular arc 180 and ledge 182 of links 168, 170, 172 except that the arc 252 subtends a smaller angle. Holes 256, 258 (FIGS. 13-14) penetrate through the leg to accommodate connector pins 230 Hole 256 is centered on the center of the circular arc 252.

Figure 17:
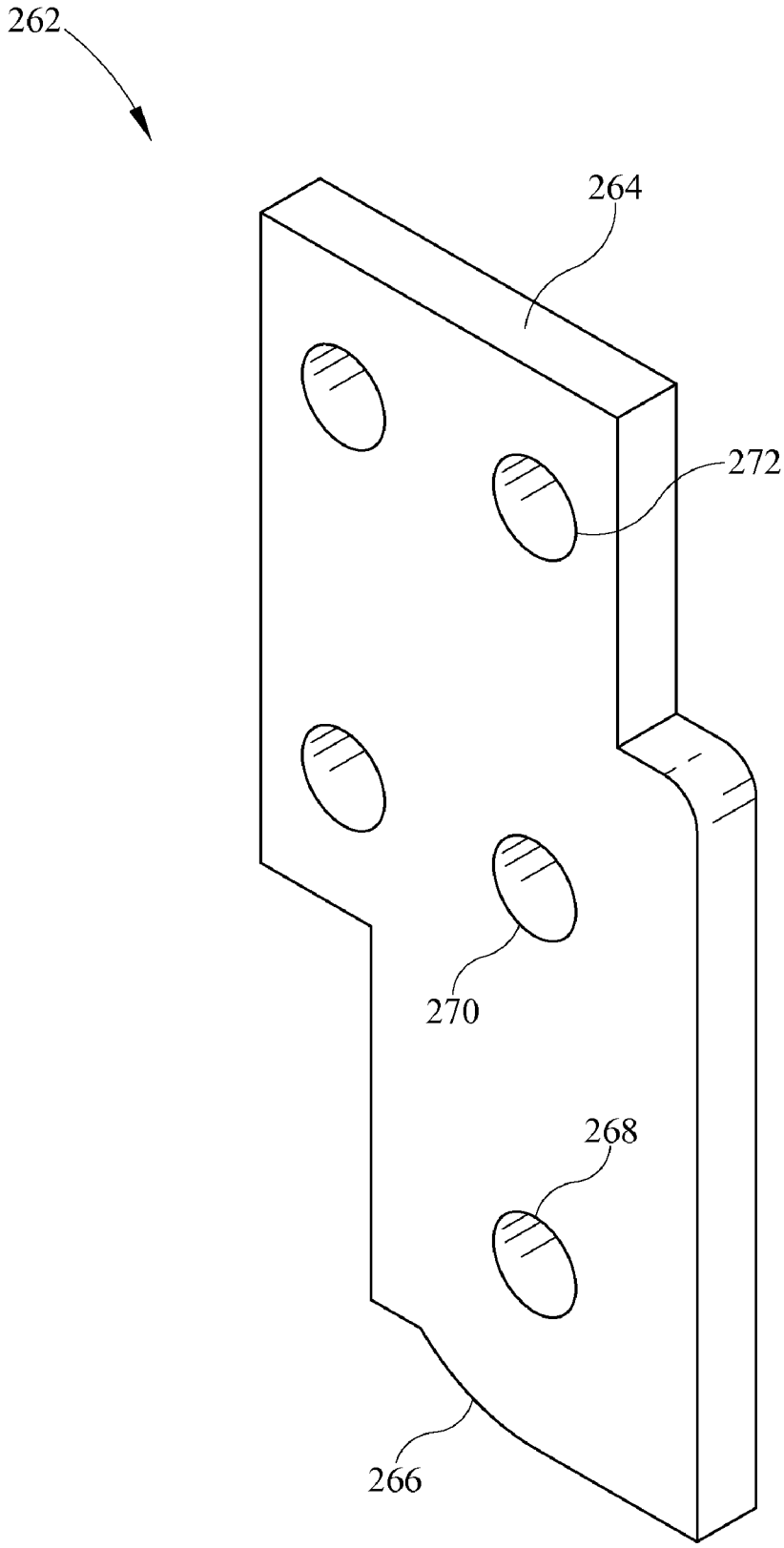
FIG. 17 is a side elevation view of a medial terminal link of the chain.

The chain also includes a medial or inboard terminal link 262 seen best in FIG. 17. One end 264 of the medial terminal link is squared off. The other end 266 has a profile similar to that of the simple end 174 of a link 168, 170, 172 thereby allowing that end 266 to engage the compound end 176 of the adjacent medial link. Holes 268, 270, 272 penetrate the medial terminal link.

Figure 12:
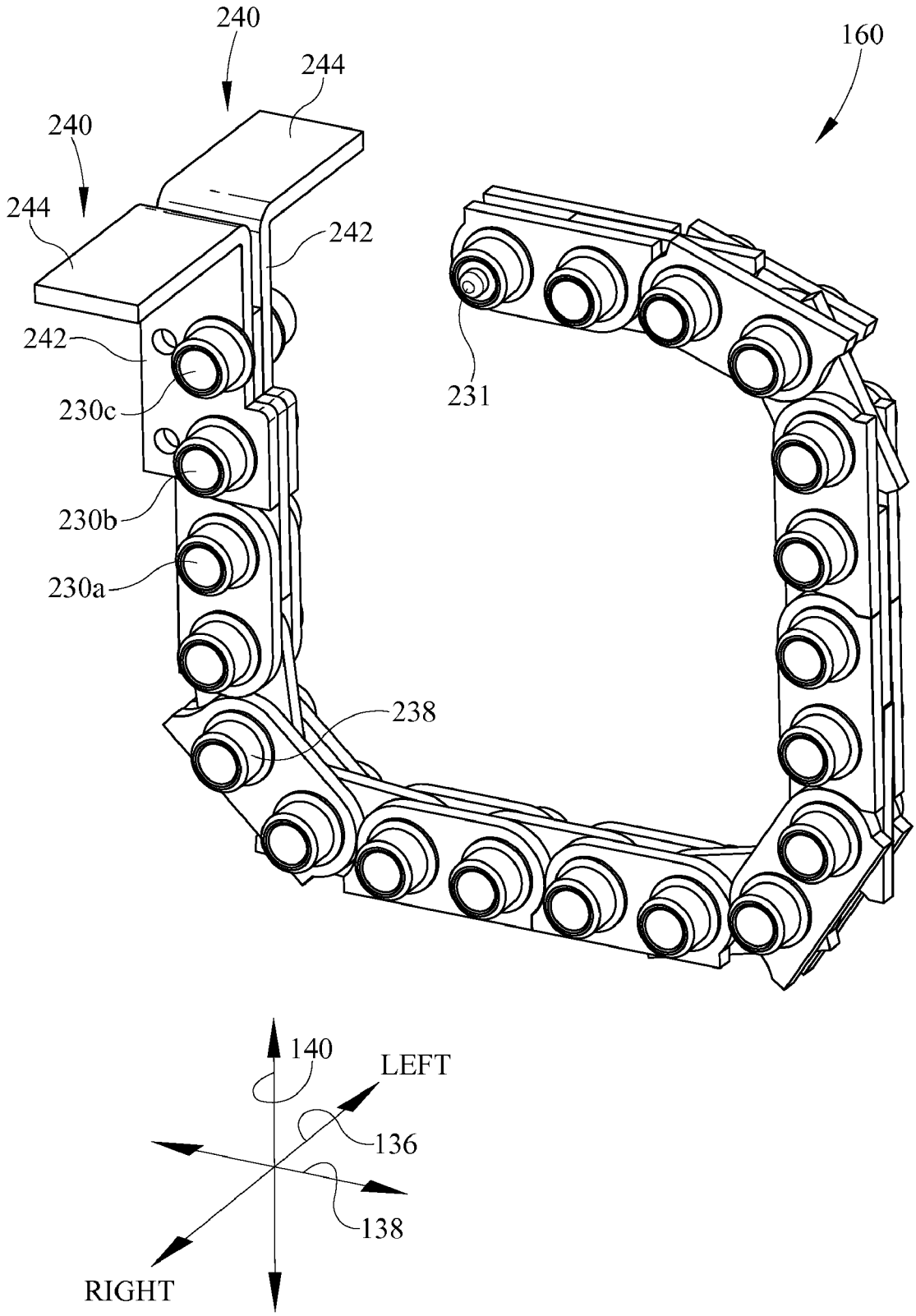
FIG. 12 is a perspective view similar to that of FIG. 9 showing the chain as it would appear if retracted into and coiled up inside the lift chain assembly.
Figure 13:
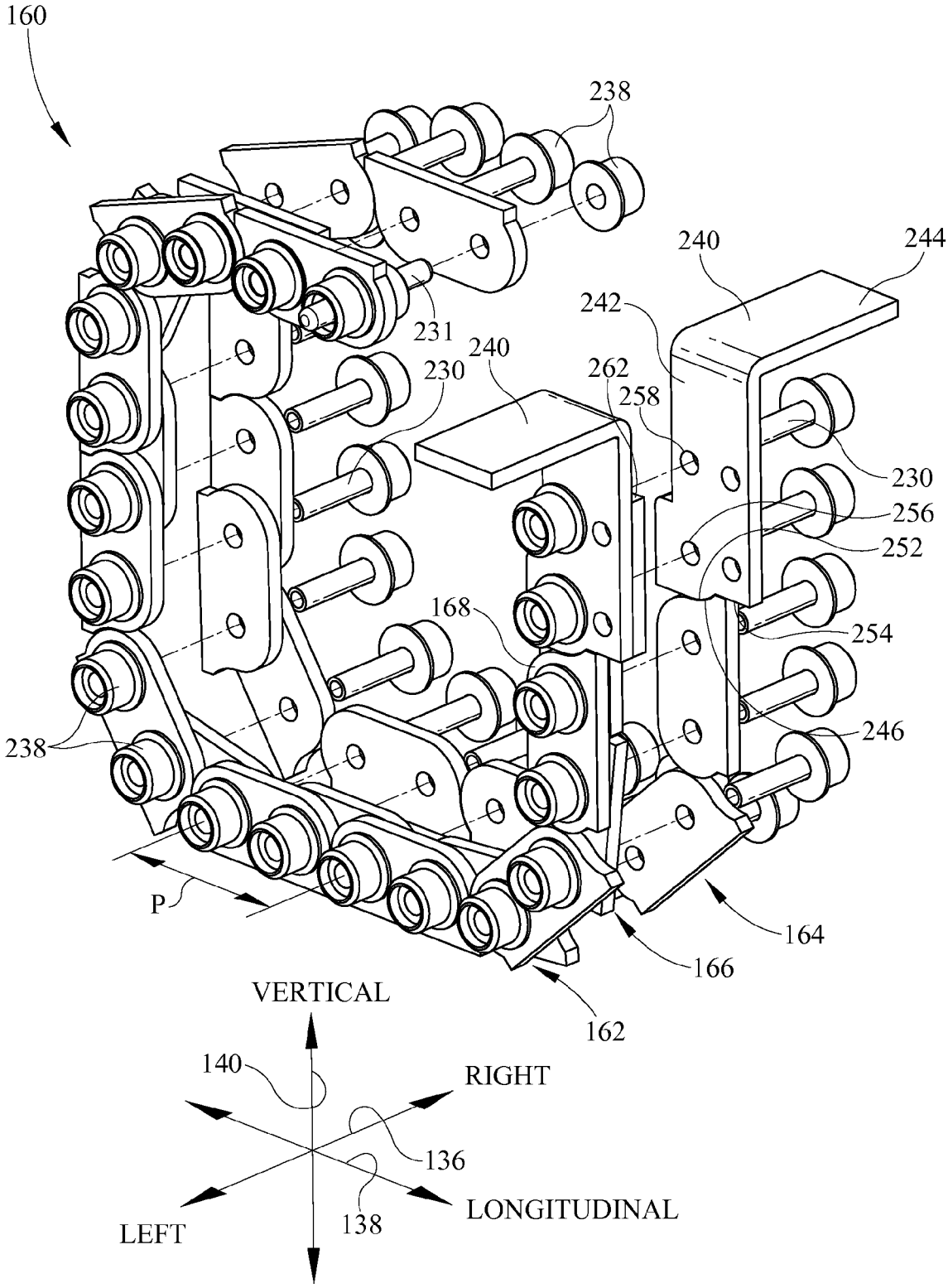
FIGS. 13 and 14 are exploded perspective views of the chain as seen by observers looking in opposite directions.

Connector pins 230 of the type already described are used to attach the terminal links to each other and to the outboard non-terminal links 168, 170 at one end of the chain. Referring to FIGS. 12 and 14, one of the pins 230, designated as 230*a*, extends through holes 214 in a pair of outboard, non-terminal links 168, 170 and through hole 268 in the medial terminal link 262. Pin designated 230*b* extends through holes 256 in the outboard terminal links and through hole 270 in the medial terminal link. Pin designated 230*c* extends through holes 258 in the outboard terminal links and through hole 272 in the medial terminal link.

A pin 231 extends through the holes 212 of the outboard links most remote from the terminal links. As seen best in FIG. 18, pin 231 is laterally longer than pins 230 so that the ends of the pin extend past the rollers 238 and into the trench portion 121 of each groove 120. A contact element 127 of a retraction stop switch 129 (FIG. 18) and an extension stop switch 130 (FIGS. 7 and 9) also project into the trench. The switches are electrically connected to the motor to limit extension and retraction of the chain as described below.

Figure 8:
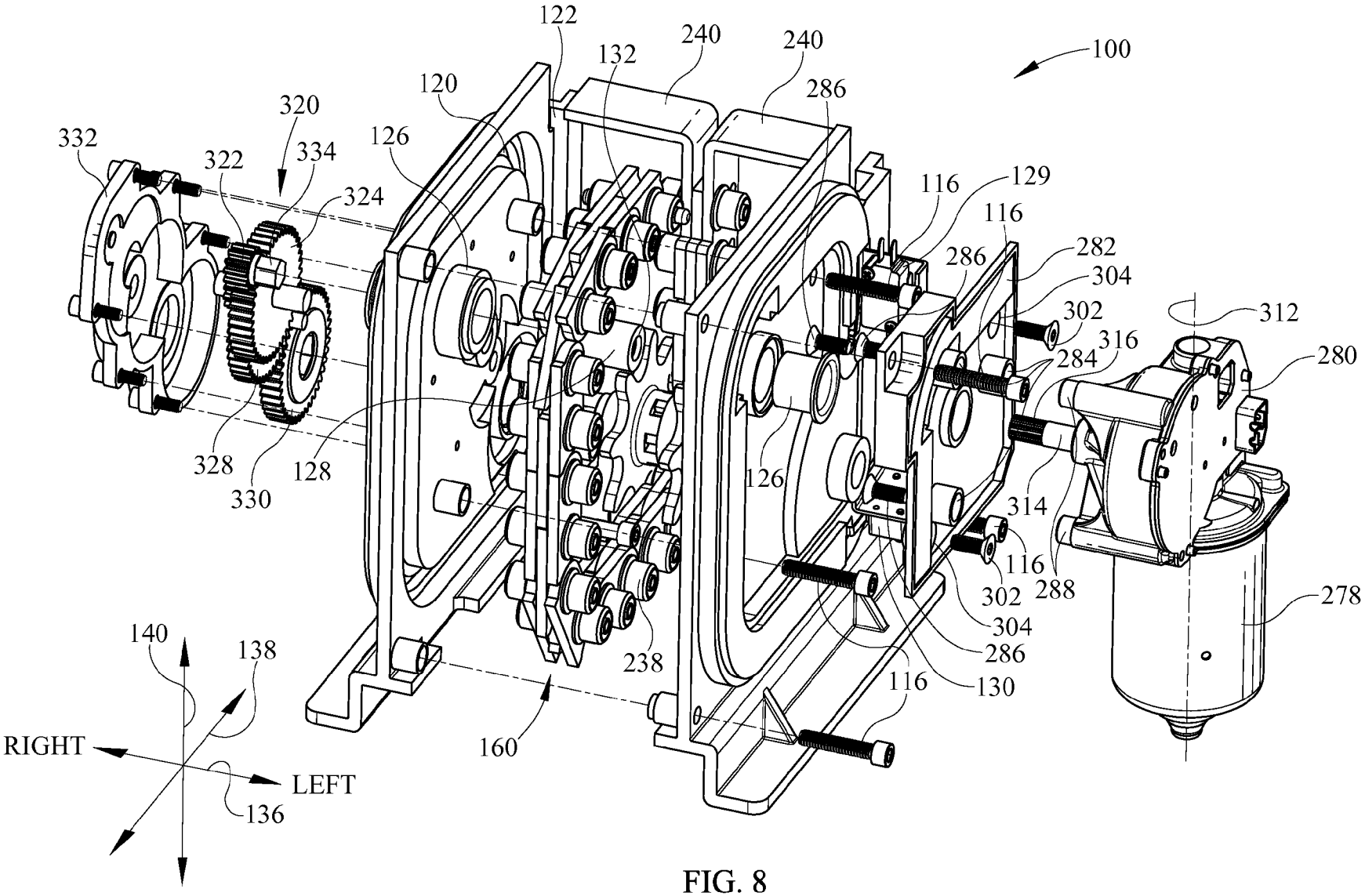
FIGS. 8 and 9 are exploded perspective views of the lift chain assembly as seen by observers looking in opposite directions.
Figure 9:
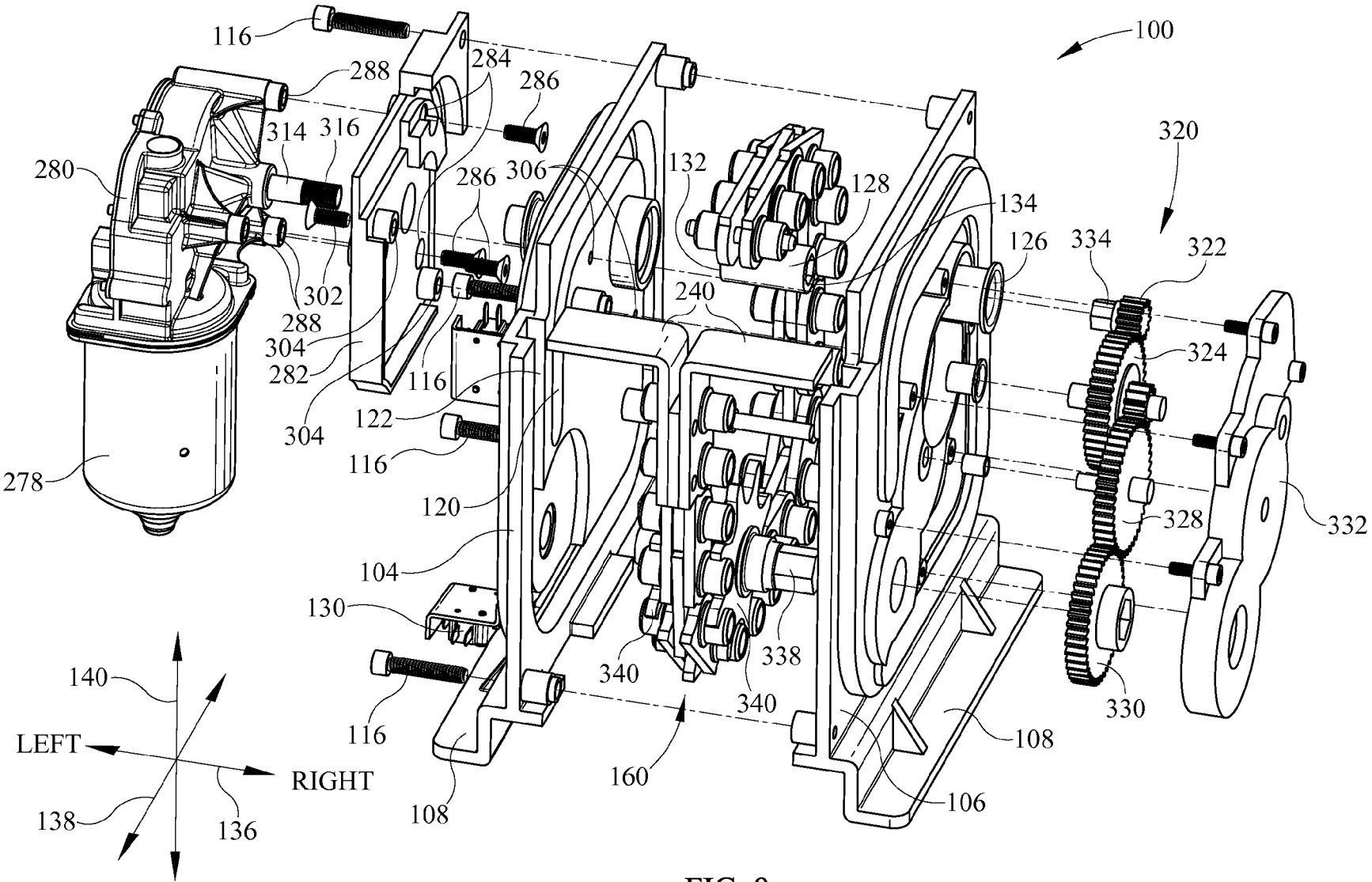
Figure 10:
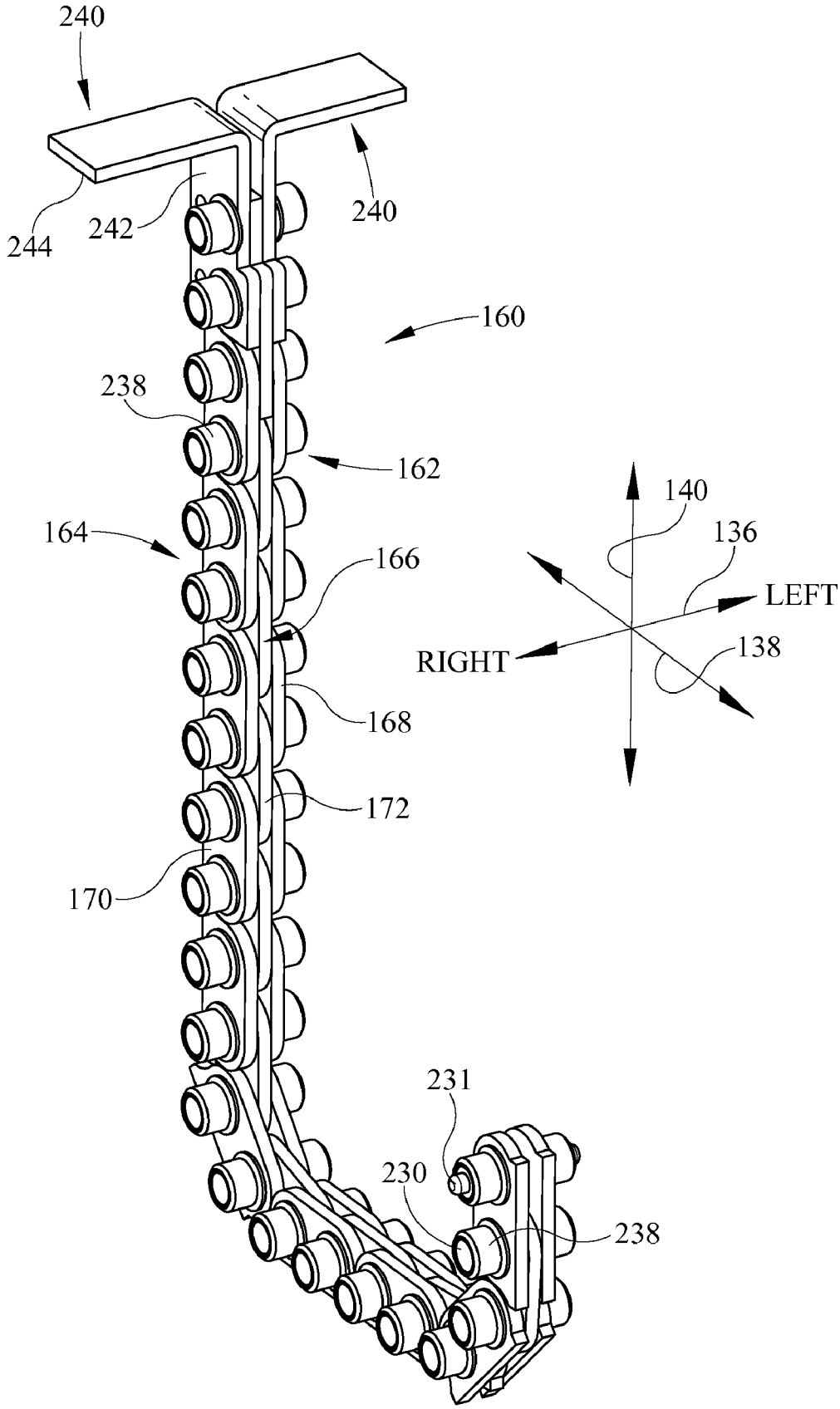
FIGS. 10 and 11 are a perspective view and a side elevation view of a chain used in the lift chain assembly as the chain would appear if partially extended from the lift chain assembly.

Referring principally to FIGS. 8-9, the lift chain assembly also includes an electric motor 278 and gearbox 280 assembly and a mounting plate 282 with motor mount bolt holes 284. The motor and mounting plate are secured to each other by motor mount bolts 286 extending through the holes 284 from the unexposed side of the mounting plate and into motor mount sockets 288 in the motor and gearbox assembly. The mounting plate 282 is secured to magazine cover 104 by plate mounting bolts 302 (not all of which are visible) extending through plate holes 304 and into bolt holes 306 (some of which are visible in FIG. 9) in the magazine cover 104. The motor has a primary shaft, not visible, rotatable about axis 312. Gearbox 280 attached to one end of the motor includes gears that mesh with a worm on the primary shaft to convey the torque and rotary motion of the primary shaft to a motor output shaft 314 oriented 90 degrees to the primary shaft. The motor output shaft has a spline drive 316 at its tip, although other configurations, such as square and hex drives, could also be used. The spline drive mates with the input side 132 of coupler 128.

The lift chain assembly also includes a gear train 320 having a pinion 322, a combination gear 324, an idler 328 and a driving gear 330. The gears reside between the magazine cover 106 and a gear train cover 332 secured to the magazine cover. A pinion drive shaft 334, which serves as a gear train drive shaft, extends from pinion and into the output side 134 of the coupler 128 to connect the pinion to the coupler. The pinion and stacked gear 324 effect a speed reduction of about 3.5:1. The stacked gear and the idler 328 effect another speed reduction of about 3.5:1. There is no speed reduction or amplification from the idler to the driving gear 330. Accordingly, the overall speed reduction from the pinion drive shaft 334 to the driving gear 330 is about 12.3:1.

The driving gear 330 is mounted on a gear train output shaft or sprocket shaft 338. The sprocket shaft is non-coaxial with the pinion drive shaft 334 and is operatively connected to the lift chain by left and right sprockets 340 (FIG. 9) also mounted on the sprocket shaft in the space between the magazine covers. The teeth of the sprockets engage the chain rollers 238 near the outboard flanks of the left and right chain arrays.

Figure 3:
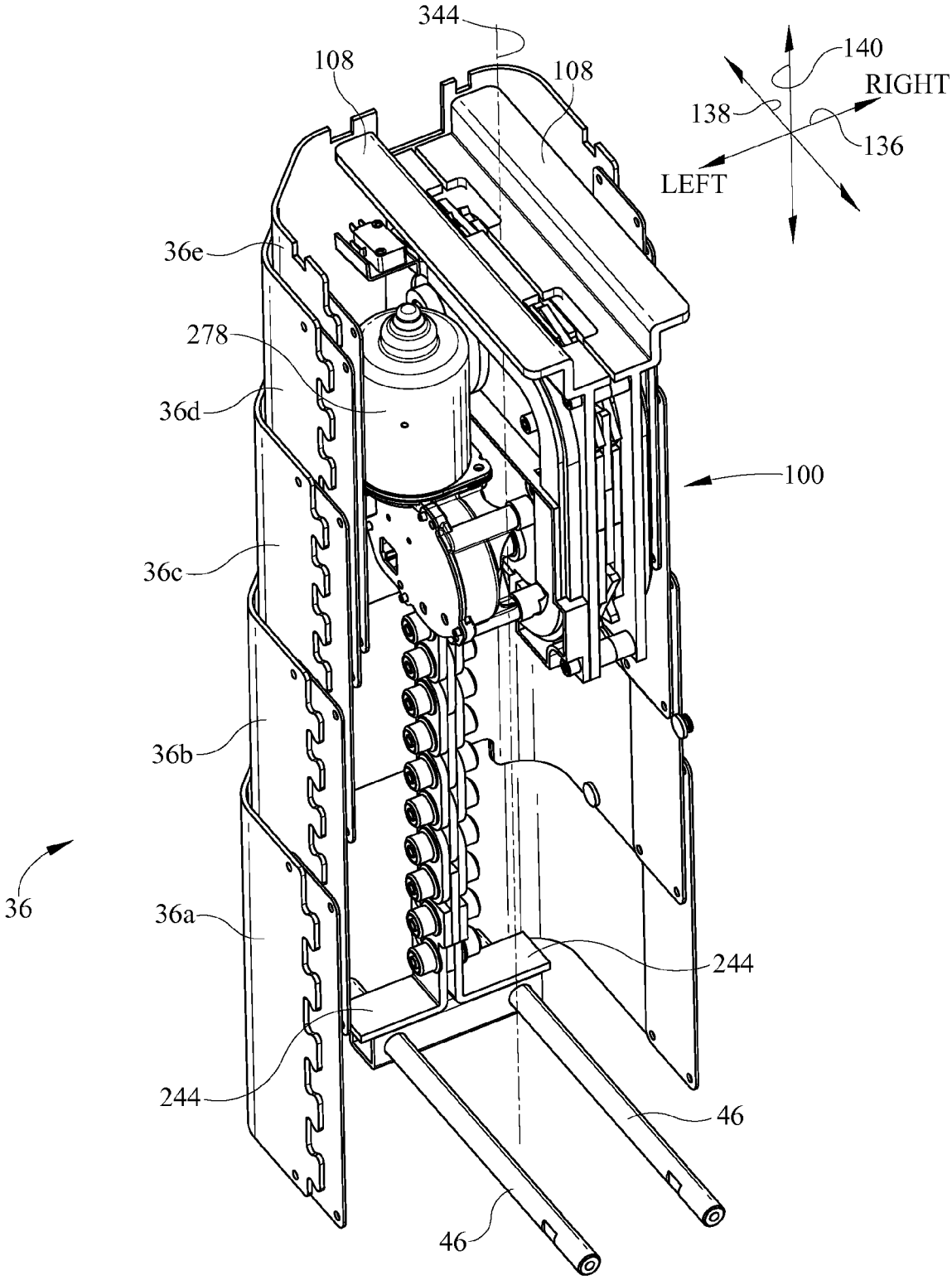
FIG. 3 is an enlarged view of one of the telescoping columns of FIG. 2.

The illustrated bed 14 includes two of the above described lift chain assemblies, each circumscribed by one of the telescopable columns 36. In each case, the mounting flanges 108 of the magazine are secured to the interior surface of upper segment cover plate 44; the feet 244 of the outboard terminal links 240 are secured to the mounting block 48 (FIGS. 2-3). Alternatively, the feet may be secured to a lower segment mounting cover similar to upper cover plate 44 if such a cover is provided. In addition, the orientation of the entire lift chain assembly could be reversed (accompanied by appropriate changes to the mounting arrangements) so that the magazine flanges 108 are vertically lower than the feet 244 rather than vertically higher than the feet. As seen in FIG. 2, the head end lift chain assembly is oriented so that the lift chain 160 emerges from the magazine closer to the right side of its telescoping column. The lift chain of the foot end lift chain assembly emerges from its magazine closer the left side of its telescoping column. As a result the mounting feet 244 are equidistantly and oppositely offset by a distance d from the longitudinal centerplane (the plane defined by axes 24, 28) of the bed. Non-equidistant offsets may also be used if desired.

It should be noted that the mounting flanges 108 of the magazine, although directly connected to the interior surface of upper segment cover plate 44, are indirectly connected to the elevateable frame 34 by way of crossbar 52 or 58. The feet 244 of the outboard terminal links 240, although directly secured to the mounting block 48, are indirectly connected to the base frame 32 by way of the mounting bars 46, base segment 36*a* and brackets 50. In principle, the mounting flanges 108 and feet 244 may each be connected directly to one of the frames rather than indirectly by way of intermediate components.

An operator's switch, not shown, is used by an operator to operate the lift system. The switch has "extend", "off" and "retract" positions. During operation, the torque and rotary motion of the motor are conveyed to the sprockets by way of the motor output shaft 314, the gear train 320, and the sprocket shaft 338. When the motor is rotated in an "extend" direction the sprockets push the chain causing the rollers, and therefore the entire chain, to move along the grooves 120 in the magazine covers. The terminal leg 122 of the groove guides the chain into a linear shape as seen at the left side of FIGS. 10-11. The chain progressively exits the magazine by way of the window 124 (FIG. 7), thereby forcing the magazine vertically upwardly, expanding the telescoping column, and raising the elevateable bed frame. Such operation continues until the operator moves the operator's switch off the "extend" position or until pin 231 acts on the extension stop switch 130. Because of the interlocking geometries of the link ends, the deployed portion of the chain inherently resists flexure in one direction. Because the magazine mounting flanges 108 and the terminal link feet 244 are connected to the upper segment cover 44 and the mounting block 48 respectively any forces that would tend to flex the chain in the opposite direction are reacted at those connections rather than being conveyed to the chain itself.

When the motor is operated in a "retract" direction, the sprockets push the chain in the opposite direction, once again causing the rollers, and therefore the entire chain, to move along the grooves 120 in the magazine covers. The chain progressively enters the magazine by way of the window 124, thereby moving the magazine vertically downwardly, collapsing the telescoping column, and lowering the elevateable bed frame. The linear portion of the chain continues to support the loads applied to the chain. The portion of the chain inside the magazine is free to flex as necessary in the direction that allows the chain to follow the shape of the groove 120 and to coil up inside the magazine thereby minimizing the amount of space required to house it. Such operation continues until the operator moves the operator's switch off the "retract" position or until pin 231 acts on the retraction stop switch 129.

Figure 4:
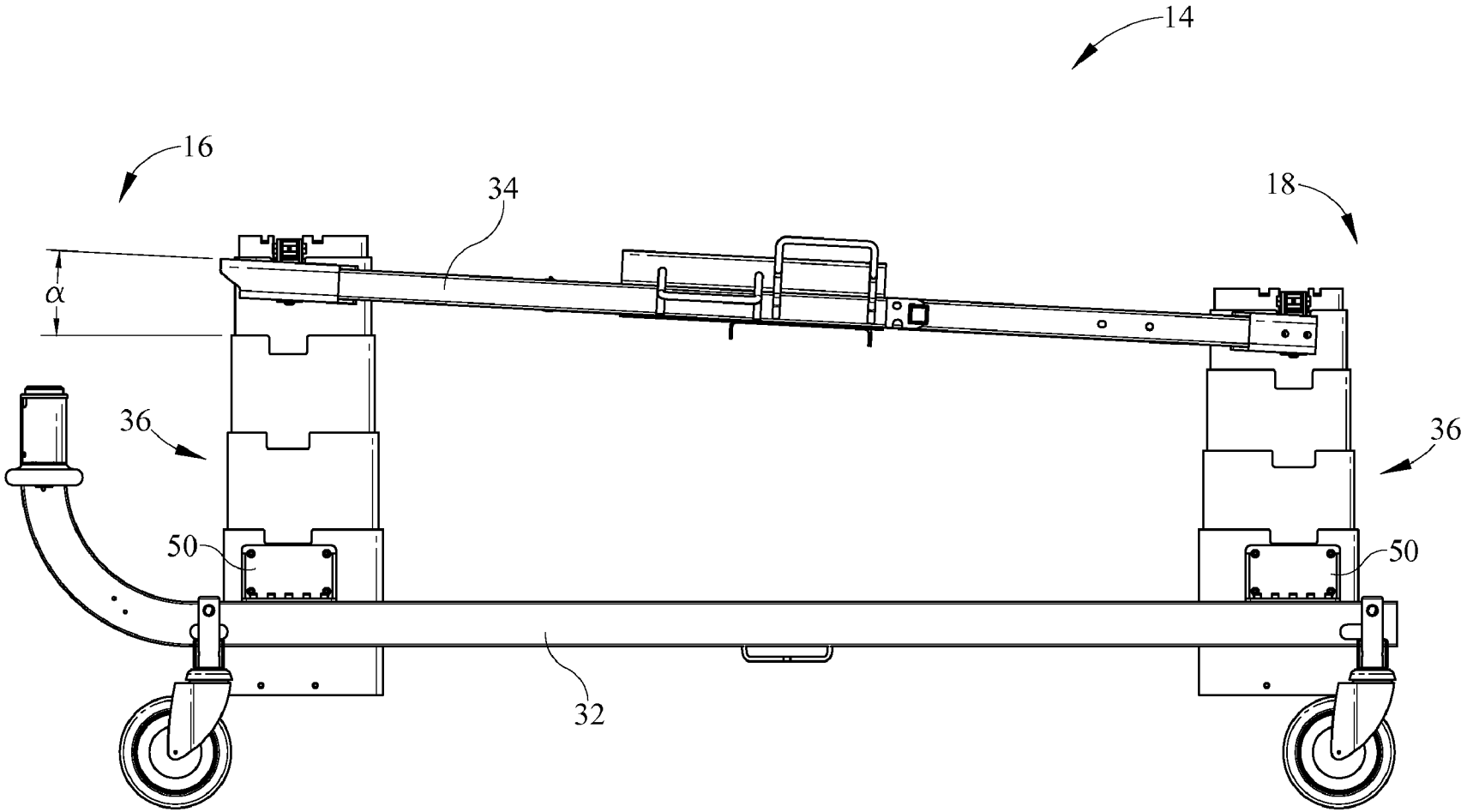
FIG. 4 is a side elevation view of the bed of FIGS. 1 and 2.

The system can, of course, be used to elevate the head and foot ends of the bed unequally to place the elevateable frame in a positive (head up) or a negative (head down) angular orientation $\alpha$ as seen in FIG. 4.

In view of the forgoing, certain additional features and attributes of the lift system can now be appreciated.

The column segments 36*a*-36*e* resist rotation relative to each other about a vertical axis 344 extending through the interior of the column. Rotational resistance may be imparted easily and inexpensively by employing segments having a non-circular shape when viewed in the vertical direction. The specific variant shown in the illustrations is approximately rectangular with rounded corners. As a result of the rotational resistance, a torque Q (FIG. 5) applied to a canister segment will be transferred to the base and elevateable frames 32, 34 by the adjacent segment or segments instead of by the chain. Consequently, the chain can be made structurally less robust, and therefore less expensively, than would be possible if it were required to react the applied torque.

As seen in FIG. 11 the feet of the terminal links have a center of loading 346 offset from the meanline 232 of the erect portion of the chain by a distance D. The offset imposes a moment on the aligned links. The direction of the offset is chosen so that the sense of the resulting moment is in the flex-resistant direction of the chain i.e. in direction $S_L$. If the load were centered on the chain meanline 232, the aligned links would be susceptible to collective flexure.

The use of the gear train 320 allows the designer to use an inexpensive, off the shelf motor whose torque-speed characteristics differ from those required at the sprocket. Without the gear train, the designer may find it necessary to bear the expense of designing a custom made motor and having it manufactured.

In addition, almost all the links are identical, the only exceptions being the outboard terminal links 240 and the medial or inboard terminal link 262. Moreover, the non-terminal links 168, 170, 172 are simple in design and therefore easy to manufacture. The link identicality and ease of manufacture contribute to low cost manufacture.

The compression chain unit is also compact enough to fit comfortably in the confined space underneath the elevateable deck frame, a space that becomes increasingly confined as the elevateable frame is lowered. As a result of the compactness, the elevateable frame can be lowered to a particularly low elevation, which improves the clinical attractiveness of the bed.

As already noted, The motor and mounting plate are secured to each other by motor mount bolts 286 extending through motor mount holes 284. The mounting plate, with the motor/gearbox assembly attached thereto as just described, is secured to one of the magazine covers by plate mounting bolts 302 extending through the plate holes 304 and into the bolt holes 306 in the magazine cover. The mounting plate is standardized to be interchangeable with respect to the magazine cover, i.e. the plate holes 304 are in the same place on all mounting plates produced by the manufacturer. However the mounting plate is customized with respect to the motor. That is, the holes 284 for bolts 286 are custom positioned depending on the model of motor to be used. Similarly, the coupler 128 is standardized to be interchangeable with respect to the pinion shaft 334, i.e. the shaft 334 is designed to mate exclusively with the output side 134 of the coupler. However the input side 132 of the coupler is customized to be compatible with the motor output shaft 314 depending on the model of motor to be used. If a bed manufacturer wishes to offer a different motor for different model beds, this can be easily done by changing only two other components of the compression chain assembly—the mounting plate and the coupler. The substituted mounting plate would differ from the baseline plate by having motor mount bolt holes 284 positioned to accommodate the different motor. The substitute coupler would differ from the baseline coupler by having a bore sized and shaped to receive the drive tip of the motor output shaft. As a result, the manufacturer can meet different customer needs while taking advantage of a high degree of parts commonality.

As described and illustrated herein, the innovative lift system is employed at both ends of the bed. However it is also possible to use the lift system at only one end of the bed and to use a conventional lift system at the other end.

Although this disclosure refers to specific embodiments, it will be understood by those skilled in the art that various changes in form and detail may be made without departing from the subject matter set forth in the accompanying claims

We claim:

1. A bed comprising:

a base frame having a head end and a foot end;

an elevatable frame having a head end and a foot end;

at least one telescopable column having a base segment connected to the base frame and a terminal segment connected to the elevatable frame, each of the at least one columns circumscribing a lift chain assembly which includes a magazine, a lift chain extensible out of the magazine and retractable into the magazine, the lift chain having a terminal link, the magazine being connected to one of the base frame and elevatable frame and the terminal link being connected to the other of the base frame and the elevatable frame.

2. The bed of claim 1 wherein the connection of the magazine and the terminal link to their associated frames is an indirect connection, the magazine being directly connected to one of the base segment and the terminal segment and the terminal link being directly connected to the other of the base segment and the terminal segment.

3. The bed of claim 1 comprising at least one intermediate telescopable column segment between the base segment and the terminal segment.

4. The bed of claim 1 wherein the columns are pivotable about a longitudinally extending column pivot axis.

5. The bed of claim 4 including a system for effecting the pivotability of the columns about the pivot axis.

6. The bed of claim 1 including exactly two of the telescopable columns, the columns being positioned near longitudinally opposite ends of the bed.

7. The bed of claim 6 wherein extension of each lift chain exerts a force for changing the relative elevations of the frames, the force exerted at the head end of the frames being laterally offset from the force exerted at the foot end of the frames.

8. The bed of claim 6 including a longitudinal centerline and wherein each of the exerted forces is offset to an opposite side of the longitudinal centerline.

* * * * *